US007066147B2

(12) United States Patent
Magel

(10) Patent No.: US 7,066,147 B2
(45) Date of Patent: Jun. 27, 2006

(54) FUEL INJECTION DEVICE WITH PRESSURE INTENSIFYING DEVICE, AND PRESSURE INTENSIFYING DEVICE

(75) Inventor: Christoph Magel, Pfullingen (DE)

(73) Assignee: Robert Bosch GmbH, Stuttgart (DE)

( * ) Notice: Subject to any disclaimer, the term of this patent is extended or adjusted under 35 U.S.C. 154(b) by 310 days.

(21) Appl. No.: 10/333,073

(22) PCT Filed: Apr. 26, 2002

(86) PCT No.: PCT/DE02/01535

§ 371 (c)(1),
(2), (4) Date: Sep. 5, 2003

(87) PCT Pub. No.: WO02/092992

PCT Pub. Date: Nov. 21, 2002

(65) Prior Publication Data

US 2004/0025845 A1 Feb. 12, 2004

(30) Foreign Application Priority Data

May 17, 2001 (DE) ..... 101 23 914

(51) Int. Cl.
*F02M 37/04* (2006.01)

(52) U.S. Cl. ..... 123/446; 123/467

(58) Field of Classification Search ..... 123/446, 123/467, 500, 501, 447, 496
See application file for complete search history.

(56) References Cited

U.S. PATENT DOCUMENTS 5,622,152 A * 4/1997 Ishida ..... 123/446
5,722,373 A * 3/1998 Paul et al. ..... 123/446
5,862,792 A * 1/1999 Paul et al. ..... 123/446
6,345,605 B1 * 2/2002 Augustin et al. ..... 123/446
6,453,875 B1 * 9/2002 Mahr et al. ..... 123/446
6,513,497 B1 * 2/2003 Mahr et al. ..... 123/447
6,634,336 B1 * 10/2003 Kropp ..... 123/467

* cited by examiner

*Primary Examiner*—Carl S. Miller
(74) *Attorney, Agent, or Firm*—Ronald E. Greigg

(57) ABSTRACT

A fuel injection device for internal combustion engines, including a fuel injector that can be supplied by a high-pressure fuel source, and a pressure intensifying device that has a movable piston is connected between the fuel injector and the high-pressure fuel source. The movable piston separates a chamber connected to the high-pressure fuel source from a high-pressure chamber connected to the injector whereby the fuel pressure in the high-pressure chamber can be varied by filling a return chamber of the pressure intensifying device with fuel or by emptying fuel from the return chamber. A valve is provided with a valve body, which can be moved as a function of the fuel pressure prevailing in the return chamber so that the valve can connect the high-pressure chamber to the chamber. The invention also proposes a pressure intensifying device that is suitable for this purpose.

26 Claims, 3 Drawing Sheets

FUEL INJECTION DEVICE WITH PRESSURE INTENSIFYING DEVICE, AND PRESSURE INTENSIFYING DEVICE

CROSS-REFERENCE TO RELATED APPLICATIONS

This application is a 35 USC 371 application of PCT/DE 02/01535 filed on Apr. 26, 2002.

BACKGROUND OF THE INVENTION

1. Field of the Invention

The invention is directed to an improved fuel injection device and a pressure intensifying device for use with internal combustion engines.

2. Description of the Prior Art

DE 199 10 970 has already disclosed fuel injection devices and pressure intensifying devices in which a pressure intensifying piston, by filling or emptying a return chamber, makes it possible to increase the fuel injection pressure beyond the level supplied by a common rail system.

SUMMARY OF THE INVENTION

The fuel injection device and pressure intensifying device according to the invention have the advantage over the prior art that the use of a valve, which connects the side of the pressure intensifying device connected to the high-pressure fuel source directly to the side connected to the fuel injector as a function of the fuel pressure prevailing in the return chamber, makes it possible to assure both a filling of the return chamber with fuel and a blocking of the side of the pressure intensifying device connected to the injector off from the high-pressure fuel source through the use of this one valve, without additional components. It must also be regarded as advantageous that the filling of the high-pressure chamber of the pressure intensifying device connected to the fuel injector does not take place by means of a for example spring-loaded separate check valve, but by means of a path that is continuously open in the reset phase. This assures an improved, particularly more rapid resetting of the piston of the pressure intensifying device.

Advantageous modifications and improvements of the fuel injection device and pressure intensifying device are also disclosed.

It is also advantageous to integrate a throttle into the piston of the pressure intensifying device so that it is no longer necessary to convey a line past the larger diameter end of the piston. This results in an even more compact design of the fuel injection device and the pressure intensifying device.

Furthermore, it is particularly advantageous to provide an additional control of the combination valve by means of the pressure increase in the high-pressure chamber so that in addition to the pressure drop in the return chamber, the pressure increase in the high-pressure chamber drives the valve body at the same time and consequently, the combination valve can switch in a particularly rapid fashion.

BRIEF DESCRIPTION OF THE DRAWINGS

Exemplary embodiments of the invention are explained in detail in the subsequent description with references to the drawings, in which.

DESCRIPTION OF THE PREFERRED EMBODIMENTS

Figure 1:
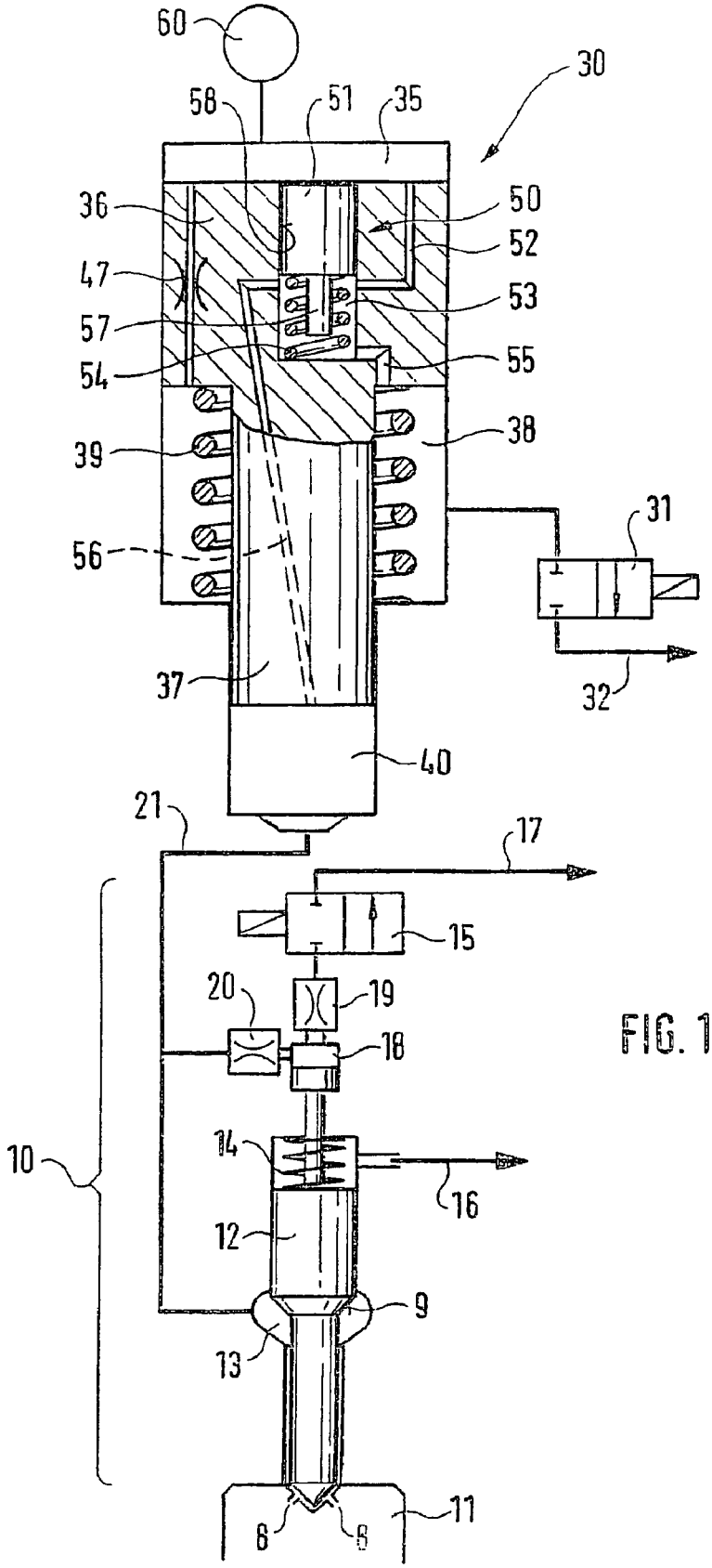
FIG. 1 shows a fuel injection device according to the invention.
Figure 2:
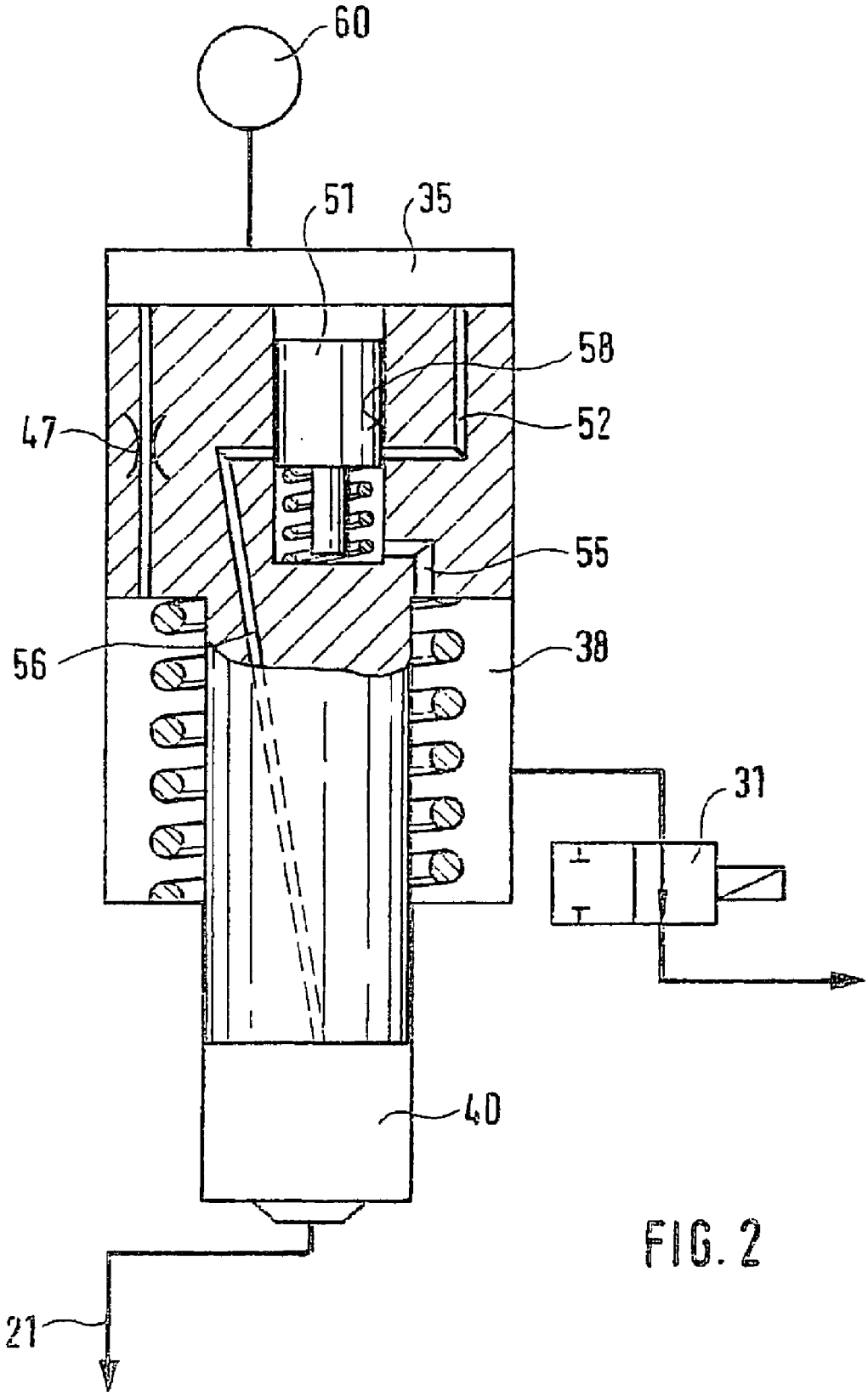
FIG. 2 shows a pressure intensifying device when activated.

FIG. 1 shows a fuel injection device in which an injector 10 is connected to a high-pressure fuel source 60 by means of a pressure intensifying device 30. The high-pressure fuel source includes a number of elements that are not shown in detail, such as a fuel tank, a pump, and the high-pressure rail of an intrinsically known common rail system in which the pump delivers fuel from the tank at a high fuel pressure of up to 1600 bar in the high-pressure rail. The injector 10 has a fuel injection valve with a valve element 12, which protrudes with its injection openings 8 into the combustion chamber 11 of a cylinder of an internal combustion engine. The valve element is encompassed at a pressure shoulder 9 by a pressure chamber 13, which is connected to the high-pressure chamber 40 of the pressure intensifying device 30 by means of a high-pressure line 21. At its end oriented away from the combustion chamber, the schematically depicted valve element protudes into a working chamber 18, which is connected by means of a throttle 20 to the high-pressure line 21 and is connected by means of a throttle 19 to a control valve 15 of the injector, the throttle 20 having a smaller opening cross section than the throttle 19. The control valve 15 is embodied as a 2/2-port directional-control valve and is closed in the first position; in the second position, it connects the throttle 19 to a low-pressure line 17. The valve element is flexibly supported by a return spring 14, which presses the valve element against the injection openings 8. The chamber of the injection valve of the injector containing the spring is connected to another low-pressure line 16. The pressure intensifying device 30 has a flexibly supported piston 36, which separates the high-pressure chamber 40 connected to the high-pressure line 21 from a chamber 35, which is connected directly to the high-pressure fuel source 60. The spring 39 used to support the piston is contained in a return chamber 38 of the pressure intensifying device 30. The piston 36 has an extension piece 37 with a smaller diameter than the piston 36 has on its end oriented toward the chamber 35. The return chamber 38 can be connected by means 2/2-port directional-control valve 31 to a low-pressure line 32. In the same way as the low-pressure lines 16 and 17, the low-pressure line 32 leads back to the fuel tank, which is not shown in detail. The chamber 35 of the pressure intensifying device is connected to the return chamber 38 by means of a throttle 47 that is integrated into the pistion in the form of a bore. In addition to the throttle bore 47, a combination valve 50 is also integrated into a bore 58 of the piston 36. The bore opens into the chamber 35 and contains a cylindrical valve body 51 in a movable fashion. A spring 54 is disposed between the piston 36 and the valve body 51 and when it is relaxed, this spring presses the valve body toward the chamber 35 just until the valve chamber 53 is connected on the one hand to a supply line 52, which is embodied as a bore in the piston and leads to the chamber 35, and is connected on the other hand to a high-pressure chamber line 56, which is embodied as a bore through the extension piece 37 and leads to the high-pressure chamber 40. In addition, a return chamber line 55, which is embodied as a bore in the piston 36 and opens into the bore 58 at the end of the bore oriented away from the chamber 35, connects the valve chamber 53 to the return chamber 38 independent of the position of the valve body 51 since the valve body 51, on its end oriented toward the spring 54, has an extension 57 that passes through the center of the spring and, as shown in FIG. 2, limits the movement of the valve bosy as soon as it has closed the lines 52 and 56.

The operation of the stroke-controlled injector 10 is already known per se from the German patent application DE 199 10 970. A high fuel pressure prevails continuously in the high-pressure line 21. Fuel travels from the pressure chamber 13, through the injection openings 8, into the combustion chamber 11 as soon as the valve element, at its end oriented away from the injection openings, is temporarily relieved of the fuel pressure through the opening of the 2/2-port directional-control valve 15 and consequently, the force acting in the opening direction engaging the pressure shoulder 9 is greater than the sum of the spring force (14) and the force resulting from the fuel pressure remaining in the working chamber 18. In the neutral state, however, the valve 15 is closed, the injection valve is closed, and no injection occurs. If the intensifier control valve 31 is also closed, then the pressure of the high-pressure fuel source prevails in the return chamber 38 and the pressure intensifying device 30 is pressure balanced so that no pressure intensification occurs. The combination valve 50 is then open and the piston 36, 37 is in its starting position, characterized by a large volume of the return chamber 38. The pressure of the high-pressure fuel source can travel through the open combination valve 50, the supply line 52, and the return chamber line 55, into the return chamber 38. The pressure of the high-pressure fuel source also travels through the supply line 52 and the high-pressure chamber line 56 to the high-pressure chamber 40 and from there, to the injector 10. Consequently, an injection can occur at any time at the pressure of the high-pressure fuel source. In order for this to occur, it is only necessary for the control valve 15 of the injector to be actuated as has already been described at the beginning, which causes the injection valve to open. If it is necessary for an injection to now occur at an increased pressure, then the intensifier control valve 31 is opened so that the pressure in the return chamber 38 can decrease, as a result of which the combination valve 50 closes. When closed, the combination valve 50 closes the high-pressure chamber line 56 and the supply line 52, as shown in FIG. 2. As a result, the fuel to be compressed in the high-pressure chamber 40 cannot flow back (check valve function of the combination valve) and the fuel only flows out of the chamber 35 in a throttled fashion through the throttle 47 and into the return chamber 38 (filling valve function of the combination valve). As a result of the pressure relief of the return chamber 38, the piston 36 is not pressure balanced and a pressure intensification occurs in the high-pressure chamber 40 in accordance with the pressure area ratio of the chamber 35 and high-pressure chamber 40. If the pressure intensifying device 30 is switched off through the closing of the intensifier control valve 31, then a pressure balance between the chambers 35, 38, and 40 is produced by means of the throttle 47. The combination valve 50 opens when the pressure in the return chamber 38 has reached the pressure in the chamber 35, minus an opening pressure difference. The opening pressure difference of the combination valve is determined by the spring constant of the spring 54 and the hydraulic pressure areas of the valve body in relation to the chambers 35 and 53. In the exemplary embodiment shown, the hydraulic pressure areas are equal in size. As soon as the combination valve has opened, the return chamber 38 and the high-pressure chamber 40 can be rapidly filled and consequently, the pressure intensifying device piston can be rapidly reset. Since the injection can occur at two different pressure levels (rail pressure and intensified pressure) and it is possible to switch on the pressure intensifying device at any time, this permits a flexible shaping of the course of the injection. This makes it possible to produce rectangular, ramp-shaped, or also boot-shaped injections with variable lengths of the boot phase.

Figure 3:
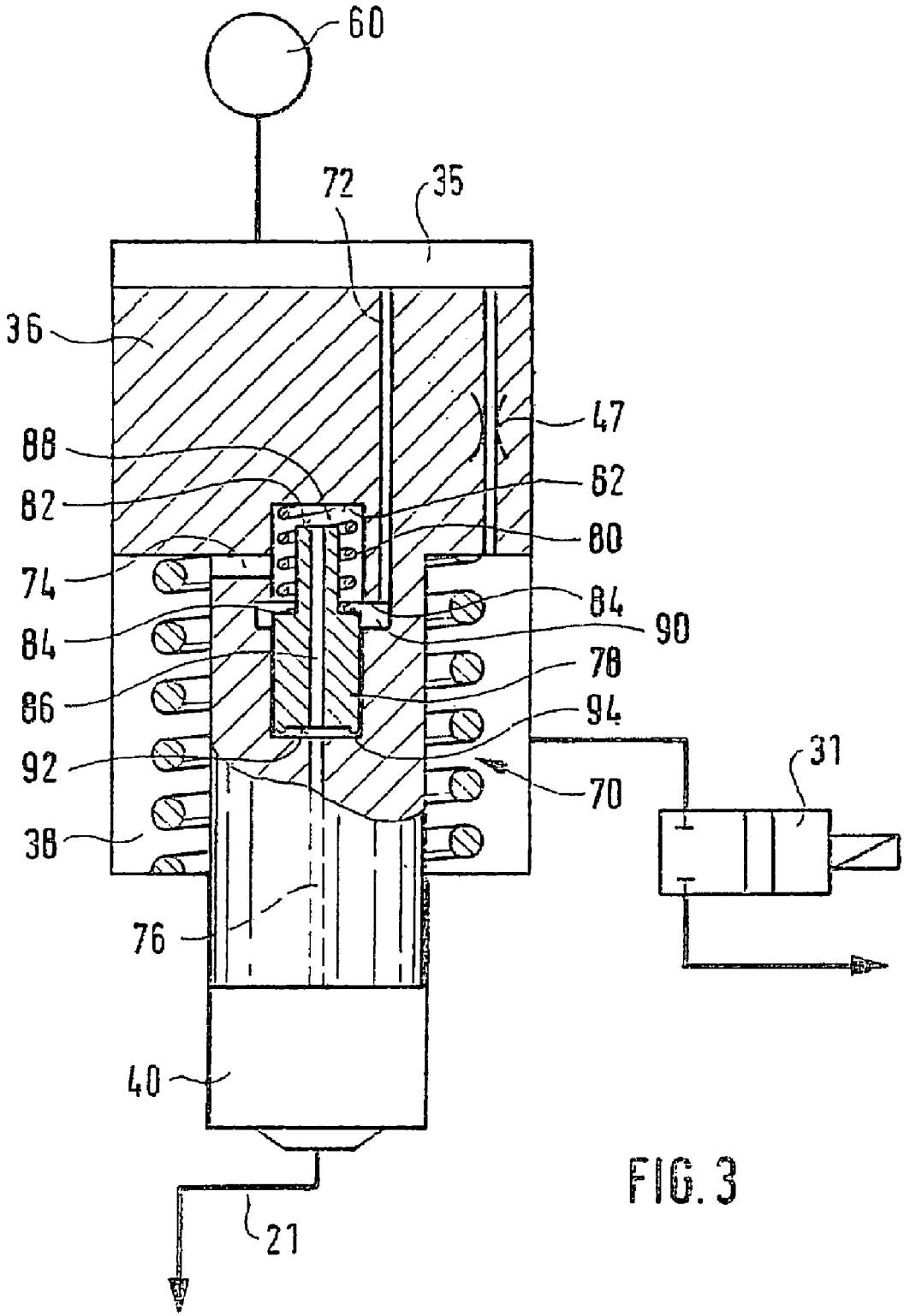
FIG. 3 shows the pressure intensifying device of a different fuel injection device embodying the invention.

FIG. 3 shows another embodiment of the fuel injection device according to the invention. The pressure intensifying device disposed between the high-pressure fuel source 60 and the high-pressure line 21 leading to the injector 10 has a piston 36 with an integrated alternative combination valve 70. The valve body 78 of the combination valve 70 is movably supported in a cylindrical cavity 88 in the piston 36. A supply line 72 embodied as a bore in the piston 36 leads from the chamber 35 into an annular groove 90 of the cavity 88. The return chamber 38 is connected to the cavity 88 by means of the return chamber line 74 independent of the position of the valve body in the cavity so that the fuel pressure prevailing in the return chamber can constantly engage the valve body. A spring 80 is clamped between the wall of the cavity 88 and a shoulder of the valve body 78 so that if forces acting on the valve body in the spring force direction predominate, then a fluid exchange between the chamber 35 and the cavity 88 can occur by means of the annular groove 90. As a result, a projection 94 on the valve body at its end oriented away from the spring 80 is pressed against the end of the cavity. A high-pressure chamber line 76 embodied as a bore in the piston connects the high-pressure chamber 40 to the part of the cavity 88 disposed between the piston wall and the pressure surface 92 bounded by the projection 94. In the neutral state of the spring 80, the region of the cavity 88, which is bounded by the end of the valve body 78 oriented toward the spring, is connected by means of a central bore 86 in the valve body to the region of the cavity, which is bounded by the end of the valve body oriented away from the spring. If the forces acting on the valve body counter to the spring force direction predominate, then the flat sealing seat surfaces 82 are pressed against each other and the bore 86 is closed. At the same time, the annular groove 90 is closed off from the rest of the cavity 88 by the slide element sealing edges 84.

Since the combination valve 70 has both a pressure surface oriented toward the high-pressure chamber 40, i.e. the pressure surface 92, and a pressure surface oriented toward the return chamber 38, it is closed both by a decreasing pressure in the return chamber and by an increasing pressure in the high-pressure chamber. The opening spring force of the spring 80 determines the opening pressure difference between the return chamber and the high-pressure chamber up to which the combination valve is open. The sealing function is thus assured for the high-pressure chamber line 76 by the flat sealing seat surfaces 82 and is assured for the supply line 72 by the slide element sealing edges 84. As in the exemplary embodiment described above, the opening of the intensifier control valve 31 in order to relieve the pressure in the return chamber 38 causes a pressure intensification in the high-pressure chamber to occur.

The foregoing relates to preferred exemplary embodiments of the invention, it being understood that other variants and embodiments thereof are possible within the spirit and scope of the invention, the latter being defined by the appended claims.

I claim:

1. A fuel injection device for internal combustion engines, with a fuel injector that can be supplied by a high-pressure fuel source, comprising a pressure intensifying device having a movable piston is connected between the fuel injector and the high-pressure fuel source, a first chamber connected to the high-pressure fuel source separated by the movable piston from a high-pressure chamber connected to the injector, the fuel pressure in the high-pressure chamber being variable by filling a return chamber of the pressure intensifying device with fuel or by emptying fuel from the return chamber, and a valve (50; 70) containing a movably supported valve body (51; 78), the valve (50; 70) being operable to connect (56, 53, 52; 76, 86, 88, 72) the high-pressure chamber (40) to the first chamber (35) and to connect (55, 53, 52; 74, 88, 72) the return chamber (38) to the first chamber (35).

2. The fuel injection device according to claim 1, wherein the valve body (51; 78) is disposed so that it can be moved as a function of the fuel pressure prevailing in the return chamber (38).

3. The fuel injection device according to claim 1, wherein the valve (50; 70) is integrated into the piston (36, 37).

4. The fuel injection device according to claim 2, wherein the valve (50; 70) is integrated into the piston (36, 37).

5. The fuel injection device according to claim 3, wherein the valve (50; 70) is connected to the first chamber (35), the return chamber (38), and the high-pressure chamber (40) by means of lines (52, 55, 56; 72, 74, 76) embodied in the form of bores integrated into the piston.

6. The fuel injection device according to claim 1, wherein the valve body can be acted on (55) at one end by the fuel pressure prevailing in the return chamber (38) and can be acted on at the other end by the fuel pressure prevailing in the first chamber (35).

7. The fuel injection device according to claim 2, wherein the valve body can be acted on (55) at one end by the fuel pressure prevailing in the return chamber (38) and can be acted on at the other end by the fuel pressure prevailing in the first chamber (35).

8. The fuel injection device according to claim 3, wherein the valve body can be acted on (55) at one end by the fuel pressure prevailing in the return chamber (38) and can be acted on at the other end by the fuel pressure prevailing in the first chamber (35).

9. The fuel injection device according to claim 4, wherein the valve body can be acted on (55) at one end by the fuel pressure prevailing in the return chamber (38) and can be acted on at the other end by the fuel pressure prevailing in the first chamber (35).

10. The fuel injection device according to claim 1, wherein the valve body can be acted on (74) at one end by the fuel pressure prevailing in the return chamber (38) and can be acted on (76) at the other end by the fuel pressure prevailing in the high-pressure chamber (40), by means of a pressure surface (92).

11. The fuel injection device according to claim 2, wherein the valve body can be acted on (74) at one end by the fuel pressure prevailing in the return chamber (38) and can be acted on (76) at the other end by the fuel pressure prevailing in the high-pressure chamber (40), by means of a pressure surface (92).

12. The fuel injection device according to claim 3, wherein the valve body can be acted on (74) at one end by the fuel pressure prevailing in the return chamber (38) and can be acted on (76) at the other end by the fuel pressure prevailing in the high-pressure chamber (40), by means of a pressure surface (92).

13. The fuel injection device according to claim 4, wherein the valve body can be acted on (74) at one end by the fuel pressure prevailing in the return chamber (38) and can be acted on (76) at the other end by the fuel pressure prevailing in the high-pressure chamber (40), by means of a pressure surface (92).

14. The fuel injection device according to claim 1, wherein the first chamber (35) is connected to the return chamber (38) by means of a throttle (47).

15. The fuel injection device according to claim 2, wherein the first chamber (35) is connected to the return chamber (38) by means of a throttle (47).

16. The fuel injection device according to claim 3, wherein the first chamber (35) is connected to the return chamber (38) by means of a throttle (47).

17. The fuel injection device according to claim 14, wherein the throttle (47) is embodied in the form of a bore integrated into the piston (36, 37).

18. The fuel injection device according to claim 1, wherein the return chamber (38) can be connected to a low-pressure line (32) by means of a control valve (31).

19. The fuel injection device according to claim 2, wherein the return chamber (38) can be connected to a low-pressure line (32) by means of a control valve (31).

20. A pressure intensifying device comprising a movable piston separating a first chamber adapted to be connected to a high-pressure fuel source from a high-pressure chamber adapted to be connected to a fuel injector, the fuel pressure in the high-pressure chamber being variable by filling a return chamber of the pressure intensifying device with fuel or by emptying fuel from the return chamber, and a valve (50; 70) provided with a movably supported valve body (51; 78) whereby the valve (50; 70) connects (56, 53, 52; 76, 86, 88, 72) the high-pressure chamber (40) to the first chamber (35) and also connects (55, 53, 52; 74, 88, 72) the return chamber (38) to the first chamber (35).

21. The pressure intensifying device according to claim 20, wherein the valve body (51; 78) is disposed so that it can be moved as a function of the fuel pressure prevailing in the return chamber (38).

22. The pressure intensifying device according to claim 20, wherein the valve (50; 70) is integrated into the piston (36, 37).

23. The pressure intensifying device according to claim 21, wherein the valve (50; 70) is integrated into the piston (36, 37).

24. The pressure intensifying device according to claim 20, wherein the valve (50; 70) is connected to the first chamber (35), the return chamber (38), and the high-pressure chamber (40) by means of lines (52, 55, 56; 72, 74, 76) embodied in the form of bores integrated into the piston.

25. The pressure intensifying device according to claim 20, wherein the valve body can be acted on (55) at one end by the fuel pressure prevailing in the return chamber (38) and can be acted on at the other end by the fuel pressure prevailing in the first chamber (35).

26. The pressure intensifying device according to claim 20, wherein the valve body can be acted on (74) at one end by the fuel pressure prevailing in the return chamber (38) and can be acted on (76) at the other end by the fuel pressure prevailing in the high-pressure chamber (40), by means of a pressure surface (92).

* * * * *